US009982976B1

(12) United States Patent
Van Valin et al.

(10) Patent No.: US 9,982,976 B1
(45) Date of Patent: May 29, 2018

(54) PAINT ARROW AND GAME

(71) Applicants: Luke Alexander Van Valin, Denver, CO (US); Jared Joseph Prestipino, Denver, CO (US)

(72) Inventors: Luke Alexander Van Valin, Denver, CO (US); Jared Joseph Prestipino, Denver, CO (US)

( * ) Notice: Subject to any disclaimer, the term of this patent is extended or adjusted under 35 U.S.C. 154(b) by 0 days. days.

(21) Appl. No.: 15/361,470

(22) Filed: Nov. 27, 2016

(51) Int. Cl.
*F42B 6/08* (2006.01)
*F42B 12/40* (2006.01)
*F42B 6/04* (2006.01)
*F42B 12/36* (2006.01)

(52) U.S. Cl.
CPC ..... *F42B 6/08* (2013.01); *F42B 6/04* (2013.01); *F42B 12/362* (2013.01); *F42B 12/40* (2013.01)

(58) Field of Classification Search
CPC ..... F42B 6/02; F42B 6/04; F42B 6/08; F42B 12/362; F42B 12/40
USPC ..... 473/577, 578, 581, 582
See application file for complete search history.

(56) References Cited

U.S. PATENT DOCUMENTS 295,304 A 3/1884 Swan
532,770 A 1/1895 Davids
735,415 A 8/1903 Sohrodel
1,348,224 A 8/1920 Kemp
1,920,257 A 8/1933 Halland
2,069,821 A 2/1934 Douglas
2,214,224 A 9/1940 Douglas
3,049,828 A 8/1962 Mills
3,472,218 A 10/1969 La Mers
3,528,662 A 9/1970 Merchant et al.
3,649,020 A 3/1972 Hall
3,672,677 A 6/1972 Moore
4,261,321 A 4/1981 Nishioka
4,634,606 A 1/1987 Skogg
4,944,521 A 7/1990 Greeno
5,009,165 A 4/1991 Morris
5,033,446 A 7/1991 Bradt
5,035,183 A 7/1991 Luxton
5,123,657 A 6/1992 Colt et al.
5,303,496 A 4/1994 Kowalkowski
5,515,785 A 5/1996 Zglenicki
5,669,836 A * 9/1997 Hill ..... F42B 6/08 473/574
5,711,284 A 1/1998 Keenan, Jr.
5,836,842 A * 11/1998 McLearan ..... F42B 6/04 473/581
5,928,049 A * 7/1999 Hudson ..... A63H 27/004 446/15

(Continued)

*Primary Examiner* — Alexander Niconovich
(74) *Attorney, Agent, or Firm* — Barber Legal; Craig W. Barber

(57) ABSTRACT

The present invention teaches an arrowhead of foam, having a front aperture leading to a front cavity: the front cavity is either an injectable paint cavity or a partial spherical shape, the aperture formed by the bisection of the cavity with the front end of the arrowhead and smaller in diameter than the cavity. The cavity diameter may be such that the resilience of the foam secures a paintball therein. The rear end of the arrowhead has a second aperture dimensioned and configured to secure an arrow shaft therein on a threaded connector. The arrowhead has a shock absorber mechanism and other details which provide for extreme cushioning of impact.

11 Claims, 17 Drawing Sheets

(56) References Cited

U.S. PATENT DOCUMENTS 6,142,895 A * 11/2000 Jason ..... F42B 12/362 473/577
6,159,117 A * 12/2000 Chan ..... F42B 6/003 446/34
6,174,251 B1 1/2001 Lemote
6,394,919 B1 5/2002 Ossege
6,450,905 B1 9/2002 Edlund
7,073,732 B2 7/2006 Abba et al.
7,488,267 B2 * 2/2009 Hunt ..... F42B 6/04 473/578
7,601,084 B2 10/2009 Martin
7,731,612 B2 * 6/2010 Martin ..... F41J 3/0004 473/581
7,861,657 B2 1/2011 Danon et al.
7,934,454 B2 5/2011 Campo et al.
8,057,330 B2 11/2011 Blosser et al.
8,087,405 B2 1/2012 Mitchell
8,371,281 B2 2/2013 Van Der Linden
8,449,413 B1 * 5/2013 Jackson ..... F42B 6/08 473/578
8,505,524 B2 8/2013 Lyon
8,932,159 B2 1/2015 Lennon et al.
9,435,621 B1 * 9/2016 Yeh ..... F42B 6/08
2006/0014598 A1 * 1/2006 Martin ..... F42B 6/08 473/578
2007/0026978 A1 * 2/2007 Martin ..... F42B 6/02 473/578
2008/0096702 A1 * 4/2008 Martin ..... F41J 3/0004 473/581
2010/0207330 A1 8/2010 Yaroch et al.
2013/0065716 A1 * 3/2013 Pierce ..... A61L 9/12 473/581
2014/0323252 A1 * 10/2014 Lennon ..... F42B 6/08 473/582

* cited by examiner

Figure 1
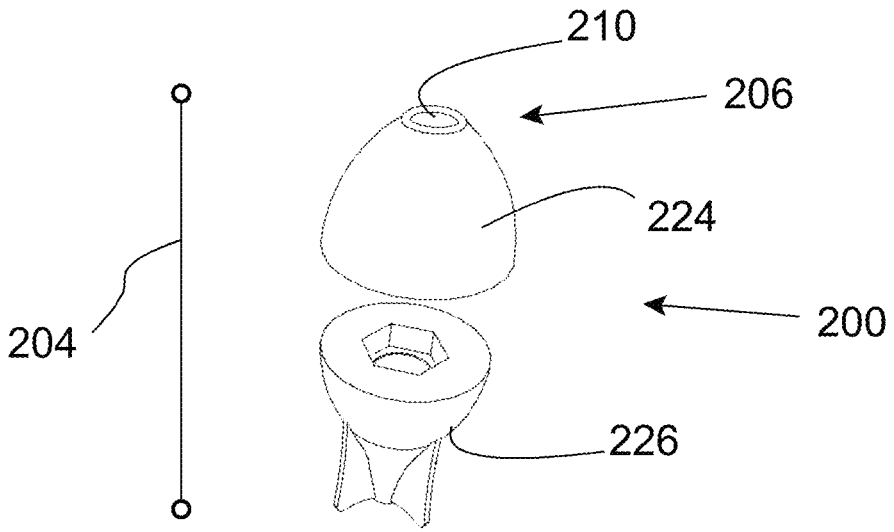
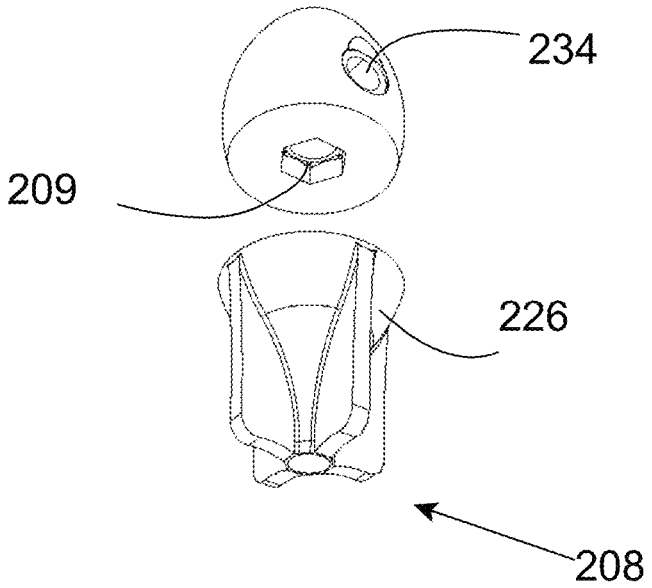
Figure 2

Figure 3
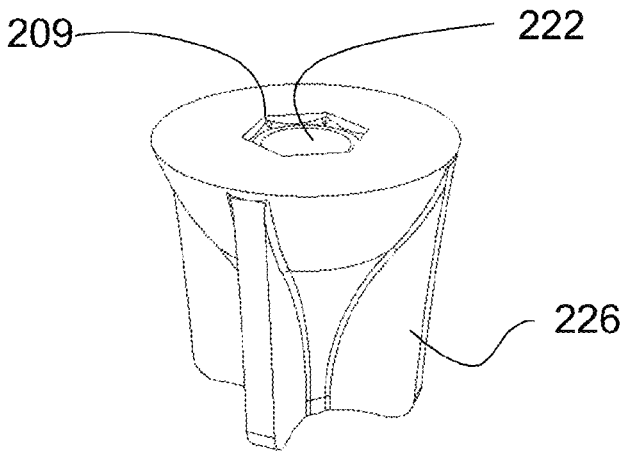
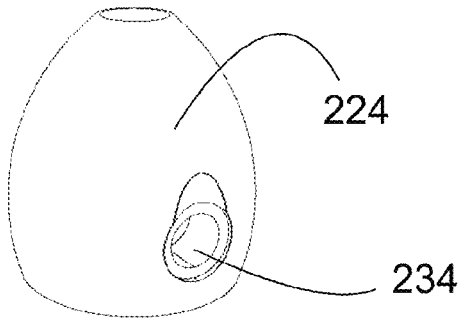
Figure 4

Figure 5
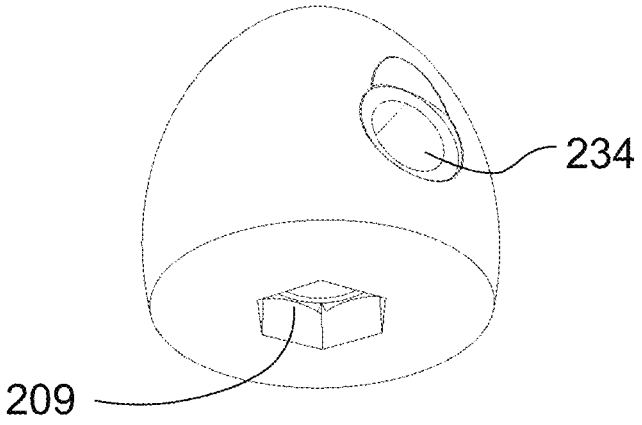
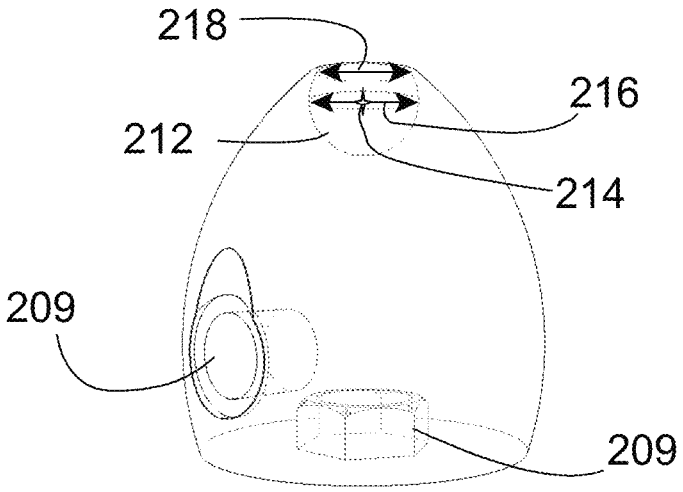
Figure 6

Figure 7
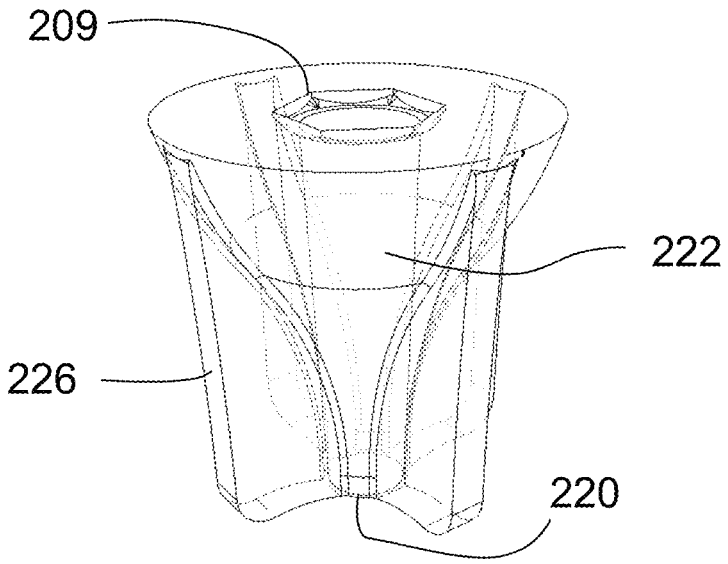
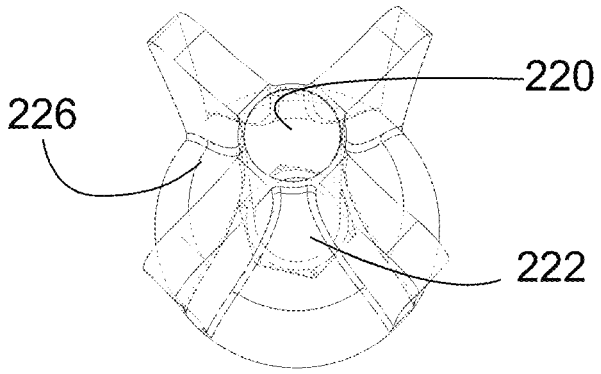
Figure 8

Figure 9
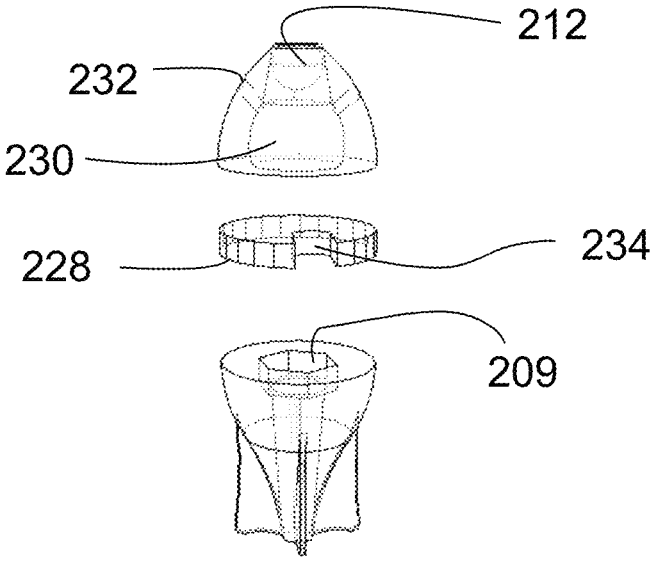
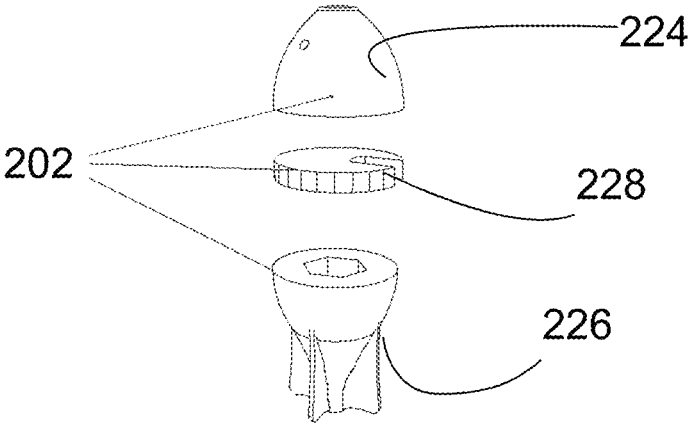
Figure 10

Figure 11
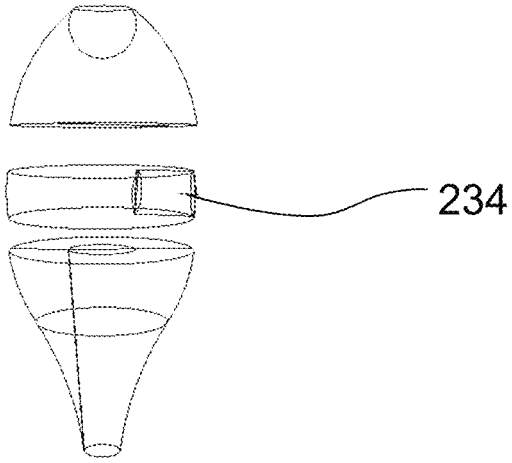
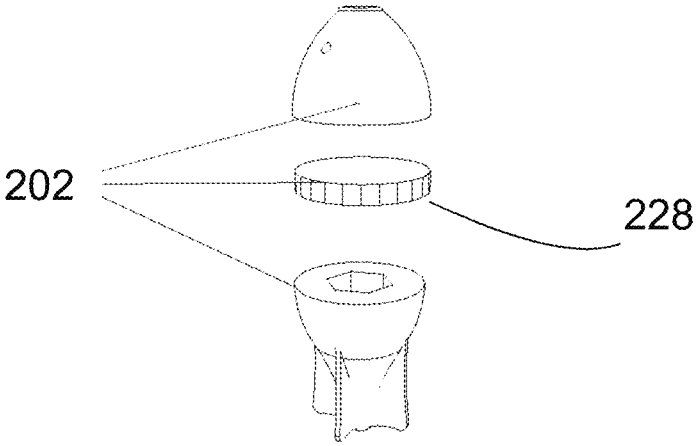
Figure 12

Figure 13
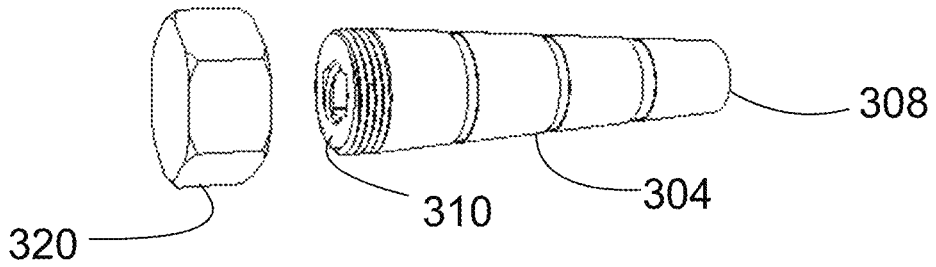
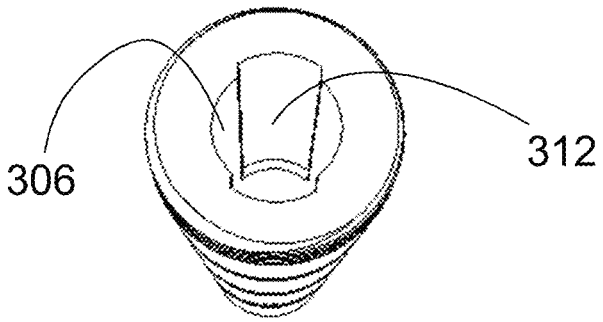
Figure 14

Figure 15
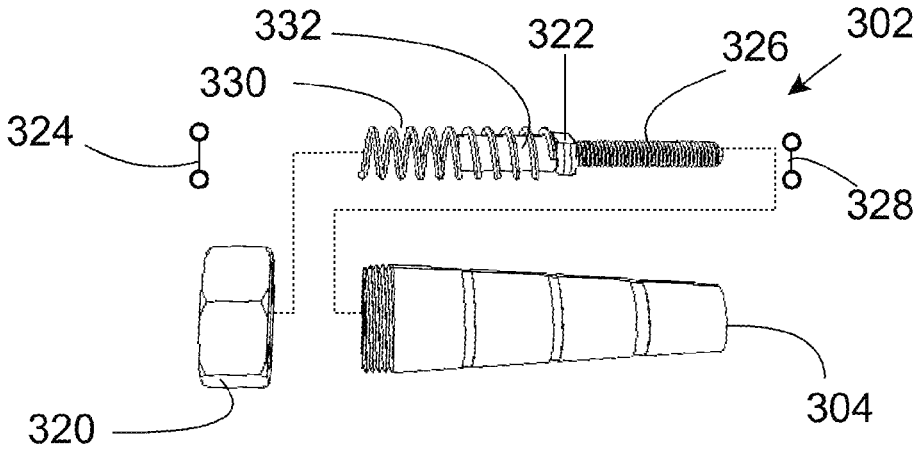
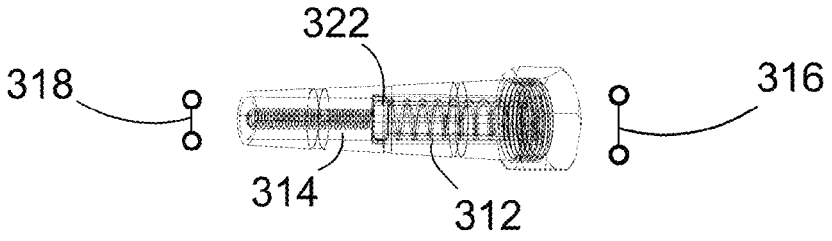
Figure 16

Figure 18
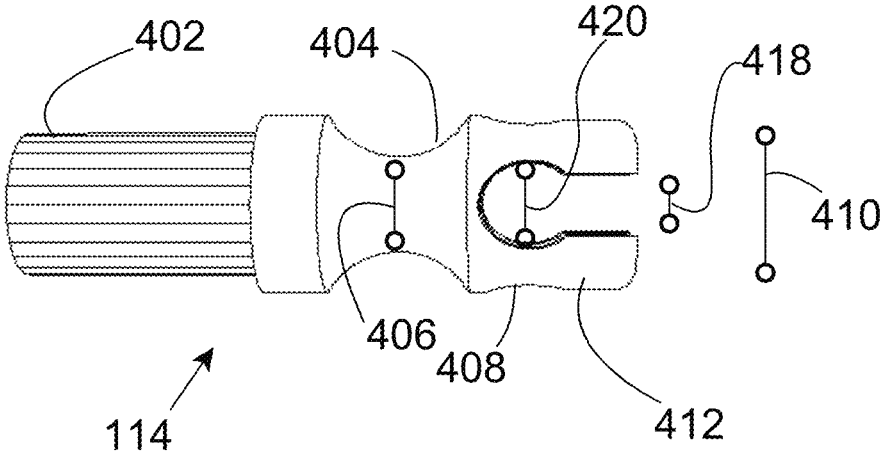
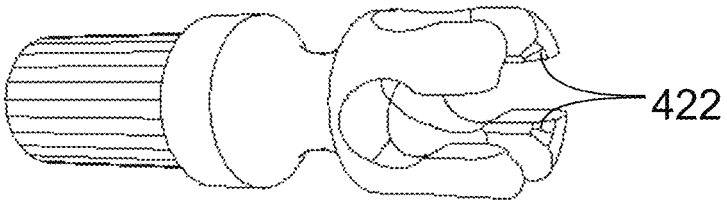
Figure 19

Figure 20
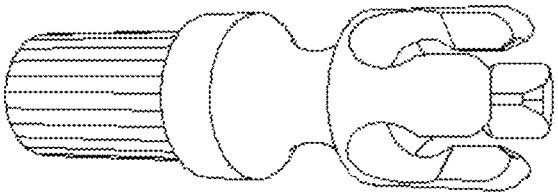
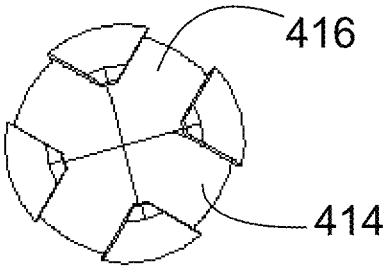
Figure 21

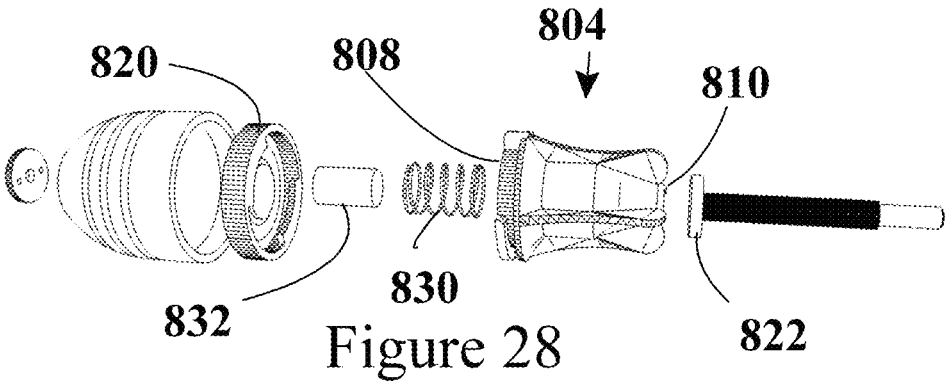
Figure 28
Figure 29
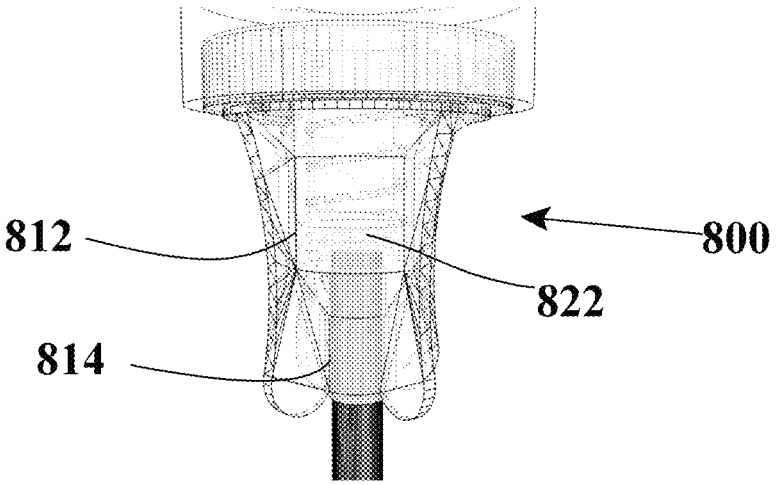

PAINT ARROW AND GAME

CROSS-REFERENCE TO RELATED APPLICATIONS

N/A

FIELD OF INVENTION

This invention relates generally to archery and specifically to arrowheads and games relating to archery, such as may be found in class 473, subclass 581.

STATEMENT REGARDING FEDERALLY FUNDED RESEARCH

This invention was not made under contract with an agency of the US Government, nor by any agency of the US Government.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

In the area of archery, a wide variety of arrowheads are known. Most are obviously designed to either provide a smooth entry into a target or for hunting, that is, most arrowheads are designed for creating maximum damage to the target.

While there seem to very few arrowheads which are designed for minimizing damage, there are a fair number which are designed for delivery of paint. The motivation for these designs is hunting: marking a tree with a scent ball helps to mask the smell of the hunters. However, the hunter obviously cannot walk up to the tree and mark it by hand without leaving their scent anyway. Thus there is a desire to mark a tree with scent or paint shot from a distance.

U.S. Pat. No. 8,449,413 to Jackson et al (May 28, 2013) (and U.S. Pat. No. 8,932,159 in the same family) teaches a design with only a single layer of protection, a foam arrowhead which connects directly to the connector to the arrowshaft.

U.S. Pat. No. 7,731,612 to Martin (Jun. 8, 2010) teaches a plastic container having a number of parts which fit together so as to hold a paint ball or scent ball onto the head of an arrow. When the arrow is fired, the various parts crush the paintball (and in some cases the parts as well), thus marking the tree as desired. A cap may be provided to prevent damage to the target. This patent also teaches in numerous ways away from the idea of safety shooting an arrow at another human being: it teaches shooting at stumps, trees, etc, and teaches a plastic cap as the only protection for the target. Other documents in the same family include U.S. Pat. No. 7,601,084 (Martin, Oct. 12, 2009), 2008/0096702 (Martin, Apr. 24, 2008), etc. These items are clearly not safe for use on human targets, as well as being by and large "single-use" items, lacking various structures and so on.

US Patent Pub. No. 2010/0207330 to Yaroch et al on Aug. 19, 2010 teaches a "rubber" material (possibly for safety) which is dipped into ink on the front end, then shot at a target on a framework.

U.S. Pat. No. 8,449,413 to Jackson et al on May 28, 2013 teaches a non-lethal arrow having a foam tip. U.S. Pat. No. 7,861,657 to Danon et al on Jan. 4, 2011 teaches another non-lethal arrowhead. Arrows having rubber suction cups, for use with tiny toy bows, are also known.

Other US Patents which teach scent or paint application by means of arrows, but which do not suggest that a human might be safely targeted by means of their structures, include:

U.S. Pat. No. Name Date
U.S. Pat. No. 735,415 Schrodel Aug. 4, 1903
U.S. Pat. No. 5,669,836 Hill Sep. 23, 1997
U.S. Pat. No. 5,711,284 Keenan, Jr. Jan. 27, 1998
U.S. Pat. No. 5,303,496 Kowalkowski Apr. 19, 1994
U.S. Pat. No. 6,142,895 Jason Nov. 7, 2000
U.S. Pat. No. 4,261,321 Nishioka Apr. 14, 1981
U.S. Pat. No. 2,214,224 Douglas Sep. 10, 1940
U.S. Pat. No. 2,069,821 Douglas Feb. 9, 1934
U.S. Pat. No. 8,371,281 Van Der Linden Feb. 12, 2013
U.S. Pat. No. 6,450,905 Edlund Sep. 17, 2002
U.S. Pat. No. 8,087,405 Mitchell Jan. 3, 2012
U.S. Pat. No. 5,035,183 Luxton Jul. 30, 1991
U.S. Pat. No. 295,304 Swan Mar. 18, 1884
U.S. Pat. No. 532,770 Davids Jan. 22, 1895
U.S. Pat. No. 6,394,919 Ossege May 28, 2002
U.S. Pat. No. 6,174,251 Lemote Jan. 16, 2001
U.S. Pat. No. 5,033,446 Bradt Jul. 23, 1991
U.S. Pat. No. 5,123,657 Colt et al Jun. 23, 1992

Other miscellaneous US Patents concerning various unrelated projectiles include:

U.S. Pat. No. 3,049,828 Mills Aug. 21, 1962
U.S. Pat. No. 1,348,224 Kemp Aug. 3, 1920
U.S. Pat. No. 3,472,218 La Mers Oct. 14, 1969
U.S. Pat. No. 3,649,020 Hall Mar. 14, 1972
U.S. Pat. No. 4,634,606 Skogg Jan. 6, 1987
U.S. Pat. No. 4,944,521 Greeno Jul. 31, 1990
U.S. Pat. No. 7,934,454 Campo et al May 3, 2011
U.S. Pat. No. 7,073,732 Abba et al Jul. 11, 2006
U.S. Pat. No. 1,920,257 Halland Aug. 1, 1933
U.S. Pat. No. 6,159,117 Chan Dec. 12, 2000
U.S. Pat. No. 3,672,677 Moore Jun. 27, 1972
U.S. Pat. No. 3,528,662 Merchant et al Sep. 15, 1970
U.S. Pat. No. 8,505,524 Lyon Aug. 13, 2013
U.S. Pat. No. 5,009,165 Morris Apr. 23, 1991
U.S. Pat. No. 8,057,330 Blosser et al Nov. 15, 2011
U.S. Pat. No. 5,515,785 Zglenicki May 14, 1996
U.S. Pat. No. 5,836,842 McLearan Nov. 17, 1998
U.S. Pat. No. 5,928,049 Hudson Jul. 27, 1999

It will be noted that none of these items teach a foam arrowhead having an aperture on the front face, the aperture part of a cavity on the front face, the cavity the shape of a sphere minus a spherical cap.

It would be preferable to provide a safe arrowhead which is designed to cushion, and additionally to absorb shock, when it impacts a target.

It would further be preferable to provide a safe arrowhead conveying a standard paintball thereon.

It would further be preferable to provide a safe arrowhead conveying a whistle therein.

SUMMARY OF THE INVENTION

The present invention teaches a foam arrowhead of large size, having a double-frustoconical shape with a flat front face and an aperture in the front face. Note that in the embodiment presently most favored there may be a paint cavity designed for injected paint. A paint cavity cap may allow paint to splash a target on impact, for example through apertures in the cap, through dislodgement, or by being a spongy material which allows transmission of paint directly through pores or interstices of the material itself. Paint may be easily injected with an injector tool or pump.

The front aperture in an alternative embodiment is part of a sectioned spherical cavity within the arrowhead having the center of sphere disposed within the arrowhead. The maximum diameter of the cavity is approximately the same as a paint ball, thus the front aperture is slightly smaller than a paintball. A threaded mounting fastener projects from a shock absorber interior, the front end of an arrow engages the fastener within the shock absorber, which includes a spring, a rubber stop, and a shock absorber body and cap.

The arrowhead may be foam material such as EVA, the safety biscuit may be a polymer material having a high degree of resilience under compression, while the shock absorber, threaded mounting fastener and arrow shaft may be of conventional materials (carbon fibers, metal, alloys, etc.). The front half of the arrowhead may also be the shock absorbing materials while the back half is a hard polymer piece which integrates the shock absorber body and fins in a single attractive unit.

The invention also teaches a game in which players shoot one another using real bows and arrows fitted with the arrowhead of the invention. A paintball gun shoots a paint ball with surprising force: by means of the invention a paintball may be shot from a bow with a force no greater, or in fact even less than, the force delivered by a paintball to a player. This force is spread over the blunt area of the front end of the arrowhead in embodiments, cushioned by the substantial depth of the arrowhead and is then cushioned further by the shock absorber between the fastening to the arrow shaft and the foam head.

It is therefore one aspect, advantage, objective and embodiment of the present invention, in addition to those described above, to provide an arrow for use with a standard diameter paintball, the arrow comprising:

a shaft, the shaft having a threaded internal bore having an internal diameter, and front and rear ends;

fletching on the outside of the shaft at the rear end;

a nock at the extreme rear end of the shaft;

an arrowhead having a body having a length and front and rear ends, the arrowhead made of resilient foam, the arrowhead having on the front end a first aperture leading to a first cavity, the first cavity being partially spherical in shape, the spherical shape being bisected by the front end of the arrowhead to create the first aperture, the center of the spherical first cavity being disposed within the arrowhead, whereby the portion of the sphere made by the first cavity is more than one half of a complete sphere;

the first cavity having a diameter sufficient to secure such standard diameter paintball by means of the resilience of the foam when such standard diameter paintball is inserted therein through the first aperture;

the first aperture having a diameter smaller than the diameter of the first cavity but large enough to allow insertion of such standard diameter paintball due to the resilience of the foam;

an externally threaded connecter dimensioned and configured to mechanically engage the internally threaded bore of the arrow shaft;

a shock absorber, the externally threaded connecter engaging the shock absorber, and the shock absorber engaging the arrowhead;

the arrowhead mounted to the arrow shaft by screwing the arrow shaft onto the externally threaded connector.

It is therefore one aspect, advantage, objective and embodiment of the present invention, in addition to those described above, to provide an arrow further comprising:

on the rear end a second aperture leading to a second cavity, the rear aperture having dimensioned and configured to accept such arrow shaft;

the shock absorber disposed within the second cavity.

It is therefore one aspect, advantage, objective and embodiment of the present invention, in addition to those described above, to provide a shock absorber further comprising:

a shock absorber body having a generally cylindrical configuration with an internal bore running from a front end to a rear end of the shock absorber body, the internal bore having a first portion having a first bore diameter and a second portion having a second bore diameter, the first portion at the front end and the second portion at the rear end of the shock absorber body;

a cap, the cap secured to the front end of the shock absorber body, the cap covering the internal bore at the front end;

the externally threaded connector having a head having a head diameter and having a threaded portion diameter, the head diameter larger than the threaded portion diameter;

the first bore diameter being larger than the head diameter, the second bore diameter being smaller than the head diameter but larger than the threaded portion diameter;

the externally threaded connector disposed with the threaded portion in the second portion of the bore, and the head in the first portion of the bore;

whereby the externally threaded connector head may be trapped within the first portion of the bore by the cap covering the internal bore at the front end and the smaller second bore diameter at the rear end of the internal bore;

a coil spring disposed within the bore between the head and the cap, the coil spring urging the externally threaded connector toward the rear end of the arrowhead;

a rubber bumper disposed within the coil spring.

It is therefore one aspect, advantage, objective and embodiment of the present invention, in addition to those described above, to provide an arrow wherein the arrowhead further comprises:

a front section and a back section, the first cavity being in the front section and the second cavity in the back section.

It is therefore one aspect, advantage, objective and embodiment of the present invention, in addition to those described above, to provide an arrow further comprising:

an intermediate section of the arrowhead between the front section and the back section.

It is therefore one aspect, advantage, objective and embodiment of the present invention, in addition to those described above, to provide an arrow further comprising:

a third cavity, the third cavity disposed within the first section of the arrowhead, the third cavity having at least one air vent which acts to vent the third cavity slowly when the arrowhead is compressed by an impact.

It is therefore one aspect, advantage, objective and embodiment of the present invention, in addition to those described above, to provide an arrow further comprising:

an opening on a side portion of the arrowhead, the opening dimensioned and configured to accept a whistle therein.

It is therefore one aspect, advantage, objective and embodiment of the present invention, in addition to those described above, to provide an arrow wherein the nock further comprises:

a first nock part dimensioned and configured to engage the extreme rear end of the arrow;

a second nock part having a second nock part diameter;

a third nock part having a third nock part diameter larger than the second nock part diameter, the third nock part having four detents projecting therefrom, the four detents projecting rearward and forming the extreme rearward portion of the nock, the four detents defining two perpendicular channels through the third nock part, the two perpendicular channels having a first width at the extreme rearward portion of the nock and a second width which is slightly greater than the first width, the four detents further having small guide-faces thereon.

It is therefore one aspect, advantage, objective and embodiment of the present invention, in addition to those described above, to provide an arrow wherein the resilient foam comprises: ethylene-vinyl acetate foam.

It is therefore one aspect, advantage, objective and embodiment of the present invention, in addition to those described above, to provide an arrowhead for use with a standard diameter paintball, the arrowhead comprising:

a body having a length and front and rear ends, the arrowhead made of resilient foam, the arrowhead having on the front end a first aperture leading to a first cavity, the first cavity being partially spherical in shape, the spherical shape being bisected by the front end of the arrowhead to create the first aperture, the center of the spherical first cavity being disposed within the arrowhead, whereby the portion of the sphere made by the first cavity is more than one half of a complete sphere;

the first cavity having a diameter sufficient to secure such standard diameter paintball by means of the resilience of the foam when such standard diameter paintball is inserted therein through the first aperture;

the first aperture having a diameter smaller than the diameter of the first cavity but large enough to allow insertion of such standard diameter paintball due to the resilience of the foam;

an externally threaded connecter;

a shock absorber, the externally threaded connecter engaging the shock absorber, and the shock absorber engaging the arrowhead.

It is therefore one aspect, advantage, objective and embodiment of the present invention, in addition to those described above, to provide an arrowhead comprising:

on the rear end a second aperture leading to a second cavity, the shock absorber disposed within the second cavity.

It is therefore another aspect, advantage, objective and embodiment of the present invention, in addition to those described above, to provide a shock absorber further comprising:

a shock absorber body having a generally cylindrical configuration with an internal bore running from a front end to a rear end of the shock absorber body, the internal bore having a first portion having a first bore diameter and a second portion having a second bore diameter, the first portion at the front end and the second portion at the rear end of the shock absorber body;

a cap, the cap secured to the front end of the shock absorber body, the cap covering the internal bore at the front end;

the externally threaded connector having a head having a head diameter and having a threaded portion diameter, the head diameter larger than the threaded portion diameter;

the first bore diameter being larger than the head diameter, the second bore diameter being smaller than the head diameter but larger than the threaded portion diameter;

the externally threaded connector disposed with the threaded portion in the second portion of the bore, and the head in the first portion of the bore;

whereby the externally threaded connector head may be trapped within the first portion of the bore by the cap covering the internal bore at the front end and the smaller second bore diameter at the rear end of the internal bore;

a coil spring disposed within the bore between the head and the cap, the coil spring urging the externally threaded connector toward the rear end of the arrowhead;

a rubber bumper disposed within the coil spring.

It is therefore one aspect, advantage, objective and embodiment of the present invention, in addition to those described above, to provide an arrowhead comprising:

a front section and a back section, the first cavity being in the front section and the second cavity in the back section.

It is therefore one aspect, advantage, objective and embodiment of the present invention, in addition to those described above, to provide an arrowhead comprising:

an intermediate section of the arrowhead between the front section and the back section.

It is therefore one aspect, advantage, objective and embodiment of the present invention, in addition to those described above, to provide an arrowhead comprising:

a third cavity, the third cavity disposed within the first section of the arrowhead, the third cavity having at least one air vent which acts to vent the third cavity slowly when the arrowhead is compressed by an impact.

It is therefore yet another aspect, advantage, objective and embodiment of the present invention, in addition to those described above, to provide a method of playing a game with two players, each player having a bow, each player having at least one arrow, the method comprising the steps of:

providing to each player at least one arrowhead, each arrowhead comprising:

a body having a length and front and rear ends, the arrowhead made of resilient foam, the arrowhead having on the front end a first aperture leading to a first cavity, the first cavity being partially spherical in shape, the spherical shape being bisected by the front end of the arrowhead to create the first aperture, the center of the spherical first cavity being disposed within the arrowhead, whereby the portion of the sphere made by the first cavity is more than one half of a complete sphere;

the first cavity having a diameter sufficient to secure such standard diameter paintball by means of the resilience of the foam when such standard diameter paintball is inserted therein through the first aperture;

the first aperture having a diameter smaller than the diameter of the first cavity but large enough to allow insertion of such standard diameter paintball due to the resilience of the foam;

an externally threaded connecter;

a shock absorber, the externally threaded connecter engaging the shock absorber, and the shock absorber engaging the arrowhead;

providing to each player safety equipment;

providing a large space in which the players may move about, the large space being free of individuals not wearing safety equipment;

allowing the players to attempt to shoot one another with the arrowheads.

BRIEF DESCRIPTION OF THE DRAWINGS

FIG. 1 is an elevated exploded side view of a first embodiment of the invention, showing the EVA head of a two-piece arrowhead embodiment.

FIG. 2 is a low angle exploded side view of a second embodiment of the invention, showing the EVA head of a two-piece arrowhead embodiment having a side cavity for a whistle or other accessory.

FIG. 3 is an elevated side view of the lower half of the second embodiment of the invention showing further details thereof.

FIG. 4 is an elevated side view of upper half of the second embodiment of the invention.

FIG. 5 is a low angle side view of the upper half of the second embodiment of the invention, showing the space in which the head of the shock absorber assembly may sit.

FIG. 6 is a transparent side view (not a cross section) showing details of the interior arrangements of the upper half of the second embodiment.

FIG. 7 is a transparent elevated side view (not a cross section) showing details of the interior arrangements of the lower half of the second embodiment.

FIG. 8 is a transparent oblique bottom view (not a cross section) showing details of the interior arrangements of the lower half of the second embodiment.

FIG. 9 is an exploded side view in transparency (not cross section) showing details of a third embodiment of the invention having an extra stiff foam biscuit between upper and lower halves and an internal air chamber with ports.

FIG. 10 is an exploded side view of the third embodiment showing the exterior thereof.

FIG. 11 is a side view in transparency of a fourth embodiment showing details of the EVA form biscuit, the whistle port, and more.

FIG. 12 is a side view of a fifth embodiment showing details of the EVA form biscuit in a version having no whistle cavity.

FIG. 13 is side view, exploded of the shock absorber body and cap of the shock absorber of the sixth embodiment of the invention.

FIG. 14 is a top view of the shock absorber body of the sixth embodiment of the invention.

FIG. 15 is an exploded view of the shock absorber body of the sixth embodiment of the invention, with the internal parts of the shock absorber shown in a different axis than the axis of the main shock absorber body and cap.

FIG. 16 is a transparent side view of shock absorber showing the assembled configuration of the shock absorber in use.

FIG. 18 is a side view of the nock embodiment (seventh embodiment) of the invention, but with the bi-directional nock aligned.

FIG. 19 is an oblique rear view of the seventh embodiment of the invention showing the bi-directional nock.

FIG. 20 is an oblique rear view of the seventh embodiment of the invention showing the bi-directional nock in a slightly different alignment.

FIG. 21 is a rear view of the nock embodiment of the invention.

FIG. 28 is an exploded view of the arrowhead and shock absorber of the most preferred embodiment of the invention.

FIG. 29 is a partially transparent view of the shock absorber of the invention, necessary to show how the working parts fit together in this simple and safe embodiment.

INDEX OF REFERENCE NUMERALS

Figure 17:
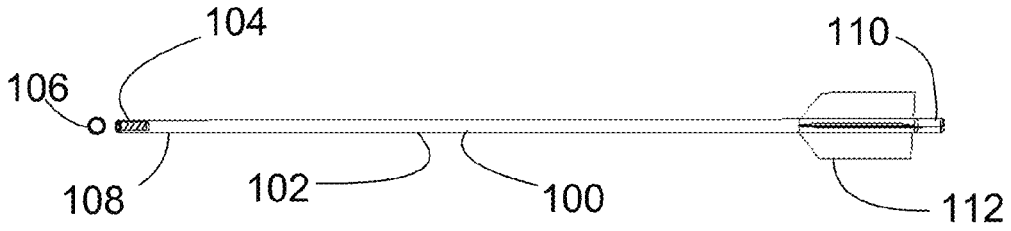
FIG. 17 is side view, partially in cross-section, of a typical arrow.

100 arrow
102 shaft
104 threaded internal bore of arrow shaft
106 threaded internal bore of arrow shaft diameter
108 front end of arrow
110 rear end of arrow
112 fletching
114 nock
200 arrowhead
202 body
204 length
206 front end of arrowhead
208 rear end of arrowhead
209: shock absorber cap cavity
210 first aperture
212 first cavity
214 center of first cavity
216 first cavity diameter
218 first aperture diameter
220 second aperture
222 second cavity
224 arrowhead front section
226 arrowhead rear section
228 intermediate section (biscuit)
230 third cavity
232 third cavity air vent
234 opening for whistle
300 shock absorber
302 externally threaded connector
304 shock absorber body
306 internal bore
308 shock absorber front end
310 shock absorber rear end
312 first portion of bore
314 second portion of bore
316 bore front portion diameter
318 bore second portion diameter
320 cap
322 bolt head
324 bolt head diameter
326 threaded portion

328 threaded portion diameter
330 coil spring
332 rubber bumper
402 first nock part
404 second nock part
406 second nock part diameter
408 third nock part
410 third nock part diameter
412 detents
414, 416 two perpendicular channels
418 first width
420 second width (lower and wider)
422 guide-faces
500 paintball
502 paintball diameter
800 shock absorber
801 arrowhead
803 body
804 shock absorber body
805 arrow shaft
806 internal bore
808 shock absorber front end
810 shock absorber rear end
812 first portion of bore
814 second portion of bore
820 cap
822 piston head
830 coil spring
832 foam bumper
836 injected paint cavity
836 paint cavity cap

DETAILED DESCRIPTION

It is therefore a preferred embodiment and best mode now contemplated for carrying out the invention, such as that shown in FIGS. 1 through 6, to provide an arrowhead safe for targeting human beings for a game of bow and arrow paintball.

FIG. 1 is an elevated exploded side view of a first embodiment of the invention, showing the EVA head of a two-piece arrowhead embodiment. Arrowhead 200 has a body 202 (shown but not numbered due to being in two pieces in this diagram) which is comprised of a front section 224 and a rear section 226. The arrowhead 200 has a length 204, a front end 206, a rear end 208, and other features as will be discussed.

It may be seen that the arrowhead is a generally aerodynamic shape suitable for stable flight in a controlled orientation. This provides safety by assuring that the foam arrowhead impacts the target, and impacts front first in an orientation suitable for maximum efficacy of the shock absorber (described later). In aid of this stability, the arrowhead may be rounded, frusto-conical or the like, and may have fins for additional stability.

The arrowhead will be made of a foam material of a nature described herein as "resilient". The foam of the invention should not be crushable (i.e. unlike Styrofoam®, which crushes and remains crushed, nor like the foam used in automobile dashboards and the like, for the same reason), nor too soft (a very soft foam will not absorb much energy during impact). More suitable foams include, for example, EVA (ethylene-vinyl acetate), or foams such as may be found in children's footballs, etc. The energy absorption characteristics of the foam are extremely important and were the subject of much experimentation by the inventors.

Aperture 210 may be seen at the tip of the arrowhead. This aperture will be discussed further, but in brief, may be used to secure a paintball into place.

FIG. 2 is a low angle exploded side view of a second embodiment of the invention, showing the EVA head of a two-piece arrowhead embodiment having a side cavity for a whistle or other accessory. Arrowhead rear section 226 may be seen in greater detail, and the underside of arrowhead front section 224 may be seen as well. Whistle opening 234 may be seen on the side of the front section 224. This opening may be dimensioned and configured to provide a whistle itself when the arrow is fired, or it may be dimensioned and configured to hold a whistle within it.

Shock absorber cap cavity 209 may hold the cap of the shock absorber discussed in reference to later figures.

FIG. 3 is an elevated side view of the rear section 226 of the second embodiment of the invention showing further details thereof. Shock absorber cap cavity 209 is visible on this section as well as on the front section, and may be seen to be an extension of the second cavity 222, which holds the shock absorber mechanism as a whole.

FIG. 4 is an elevated side view of front half/section 224 of the second embodiment of the invention. In this view the tip located first aperture 210 (for a paintball) and the side located opening 234 (for a whistle) may be clearly distinguished.

FIG. 5 is a low angle side view of the front section 224 of the second embodiment of the invention, showing the space in which the head of the shock absorber assembly may sit, 209, distinguished from the whistle space 234.

FIG. 6 is a transparent side view (not a cross section) showing details of the interior arrangements of the front section 224 of the second embodiment. By using transparency, first cavity 212, whistle opening 234 and shock absorber cap cavity 209 may be clearly distinguished.

In addition, details of the dimensions and configuration of first cavity 212 may be better understood. In particular, the relationship of the diameter 216 of first cavity 212 to the diameter 218 of the first aperture 210 may be more clearly understood. Diameter 216 of the first cavity is approximately the same as the diameter of one standard paintball size. (For example, most paintballs are 0.68 inch, and thus paintball gun barrels often have a bore of 0.689, although there are other standard sizes to which the cavity may be matched instead in alternative embodiments). Diameter 218 of the aperture 210 however, is approximately the same diameter as a chord of a standard paintball size, rather than a diameter of it, and is thus somewhat smaller. The resilience of the foam allows the diameter of the paintball to be passed through the smaller aperture to end up secured inside of the cavity. The center of the paintball thus will sit at the center of the cavity 214, with the narrower aperture 210 restraining it.

For purposes of this application, the term "approximately equal" indicates that the foam's resilience will allow the paintball to pass through a slightly smaller aperture (diameter 218) but then sit restrained on all sides (diameter 216).

FIG. 7 is a transparent elevated side view (not a cross section) showing details of the interior arrangements of the rear section 226 of the second embodiment. Cap cavity 209 and overall shock absorber cavity 222 may be seen. In transparency, second aperture 220 may be made out at the extreme rear end of the arrowhead: this aperture may be dimensioned and configured to accept a standard arrow shaft thereinto. FIG. 8 is a transparent oblique bottom view (not a cross section) showing details of the interior arrangements of the rear (lower) half 224 of the second embodiment: in this view the second aperture 220 may be seen more clearly providing the access to the shock absorber cavity 222.

FIG. 9 is an exploded side view in transparency (not cross section) showing details of a third embodiment of the invention having an additional stiff foam biscuit 228 between front and rear sections and an internal air chamber 230 with ports/vents 232. This third embodiment has the intermediary section (or biscuit) 228 disposed between the other two sections in order to provide additional impact energy absorption foam between the tip of the arrowhead and the cap of the shock absorber, and to allow the cap cavity 209 to sit entirely within the rear section of the arrowhead.

With the additional foam provided, it is safe to have a large third cavity 230 in the front section of the arrowhead. This third cavity has at least one vent 232 (in this case, a tunnel leading out from the interior cavity 230 to the ambient air). Under impact, the air within the third cavity 230 is compressed and seeks escape through the vent 232. However, the vent size and diameter may be carefully controlled so that an exact degree of energy absorption due to air compression and escape may be provided. By this means, yet another form of energy absorption (in addition to the shock absorber and the foam) is provided. It will be appreciated that having multiple levels of energy absorption is advantageous in causing cushioning to occur at different energy levels and thus be spread out, rather than shorter. One way to look at this would be to say that the deceleration of the arrow on impact is spread out over a greater time period, resulting in a lower derivative of deceleration (the derivative of acceleration, (which is equivalent to the third derivative of position), is generally referred to as "jolt", "surge" or "jerk"). As is well known, the human body can withstand only certain amounts of acceleration or deceleration (expressed in g forces), what is less well known is that human beings' bodies can also withstand only a limited degree of jolt as well. Since the present invention is specifically designed to provide safe use of bow and arrow on human targets for a paintball game, this quantity has to be reduced and multiple layers/degrees of energy absorption are employed for this purpose.

FIG. 10 is an exploded side view of the third embodiment showing the exterior thereof. Arrowhead body 202 may be seen to be made up of three overall sections: front section 224, rear section 226, and intermediary section 228.

FIG. 11 is a side view in transparency of a fourth embodiment showing details of the EVA form biscuit, the whistle port, and more. This embodiment lacks fins and provides a smoother shape, and shows whistle opening 234 in another possible configuration. FIG. 12 on the other hand is a side view of a fifth embodiment arrowhead body 202 showing details of the EVA form biscuit 228 in a version having no whistle cavity.

The shock absorber portion of the invention will now be addressed. It will be appreciated that the mass of the overall arrow includes the weight of the arrow shaft, nock and fletching behind the arrowhead. Thus, it is beneficial to absorb energy from this mass as well as the (low) mass of the airhead. The shock absorber mechanism is thus provided.

FIG. 13 is side view, exploded of the shock absorber body and cap of the shock absorber of the sixth embodiment of the invention. The shock absorber has a body 304 and a cap 320, a front end 310 and a rear end 308. The cap 320 covers the front end 310, capping and sealing the bore within the shock absorber body 304.

FIG. 14 is a top view of the shock absorber body of the sixth embodiment of the invention. The diameter of the internal bore 306 is not uniform from end to end, rather it has a bore front/first portion 312 and a bore rear/second portion (not easily seen in his view) which are different. Note that this view does NOT show the interior of the bore from end to end, only a fraction of the length near the front end of the shock absorber body.

FIG. 15 is an exploded view of the shock absorber body of the sixth embodiment of the invention, with the internal parts of the shock absorber shown in a different axis than the axis of the main shock absorber body and cap. Thus body 304 and cap 320 may be seen with the internal parts removed for easy viewing.

Externally threaded connector 302 is shown, having a threaded portion 326 (having a threaded portion diameter 328) and a head 322 having a head diameter 324. The externally threaded connector 302 may be termed a "bolt", and may resemble a bolt or even be a bolt in alternative embodiments. The "bolt head" 322 has a coil spring 320 sitting/disposed thereon. The coil spring 320 has a rubber stopper or bumper 332 sitting/disposed therewithin. The assembly of the interior of the shock absorber 300 is thus shown by this partially exploded view. In practice, the shock absorber itself has two different levels of energy absorption internally: the coil spring 320 and the rubber bumper 332, again with the goal of both reducing deceleration (g forces) and also of spreading out the deceleration (jolt) thus reducing both force (mass times deceleration) and the derivative of force (the engineering term "yank" is used for the derivative of force).

FIG. 16 is a transparent side view of shock absorber showing the assembled configuration of the shock absorber 300 in use. It may be seen that the internal bore first portion 312 has an internal diameter 316 which is larger than second portion 314 internal diameter 318. Meanwhile, the connector head 322 (bolt head) is larger than the internal diameter 318, but smaller than the internal diameter 316, so with the cap on, the head 322 is trapped in the first portion 312 and cannot enter the second portion 314. The thread portion 326 of the connector however does fit inside the smaller diameter bore 318, so the threaded portion may extend out of the rear end of the shock absorber (in alternative embodiments in which the connector 302 is longer than the second portion of the bore 314, or may extend into and along the second bore portion 314 if it is the same length (as shown) or shorter.

In use, the arrow shaft (not yet shown) is internally threaded and the second bore portion 314 is sized to permit the arrow shaft to enter it, where it can be threaded onto the connector 302. Reverting back to FIG. 14 momentarily, it will be recalled that the larger bore portion 312 may be interrupted (NOT extend around the entire circumference of the bore) so that the "bolt head" 322 cannot rotate within bore portion 312, thus making screwing the arrow shaft onto the connector much easier.

FIG. 17 is side view, partially in cross-section, of a typical arrow. Arrow 100 has shaft 102 having front end 108 and rear end 110. The front end 108 has a threaded internal bore 104, which in turn has its own diameter 106. As previously mentioned, the connector 302 has an external threaded diameter chosen to match internal diameter 106 of the arrow, while the rear aperture 220 and second bore portion 318 of the shock absorber are sized to permit the arrow shaft 102 to enter.

Rear end 110 has thereon fletching/flights 112 and on the extreme rear end of the arrow shaft, nock 114.

Figure 23:
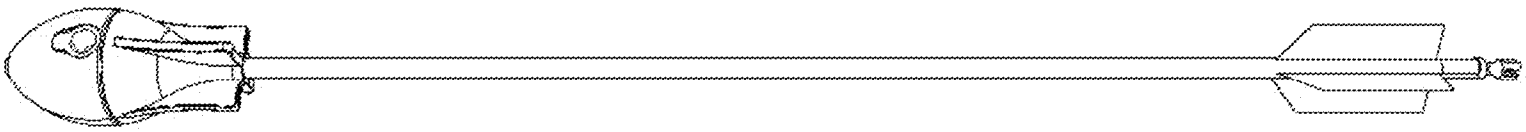
FIG. 23 is a side view of an arrow with the arrowhead of the invention mounted thereto.

FIG. 23 is a side view of an arrow with the arrowhead of the invention mounted thereto, showing the complete invention with the nock embodiment, the arrowhead embodiment (having the shock absorber embodiment unseen within), and so on.

FIG. 18 is a side view of the nock 114 embodiment (seventh embodiment) of the invention, but with the bi-directional nock aligned. First nock part 402 is designed to fit within the arrow shaft 102. Second nock part 404 has a second nock part diameter 406 which is immediately seen to be smaller than the diameter 410 of the third nock part 408. The third nock part 408 has thereon, at the extreme rear end, four detents (only two visible in this aligned view) 412, which define channels for accepting a bow string. The channels have a first width 418 and a second width 420, lower in the channel and wider, which width differences assist with nocking an arrow and then holding the arrow nocked easily.

FIG. 19 is an oblique rear view of the seventh embodiment of the invention showing the bi-directional nock. For additional assistance with nocking of an arrow (that is, with inserting the string into the nock's channels) guide faces 422 may be provided. FIG. 20 is an oblique rear view of the seventh embodiment of the invention showing the bi-directional nock in a slightly different alignment.

FIG. 21 is a rear view of the nock embodiment of the invention. In this view the two perpendicular channels 414 and 416 passing through/across the nock may be seen more clearly.

Figure 22:
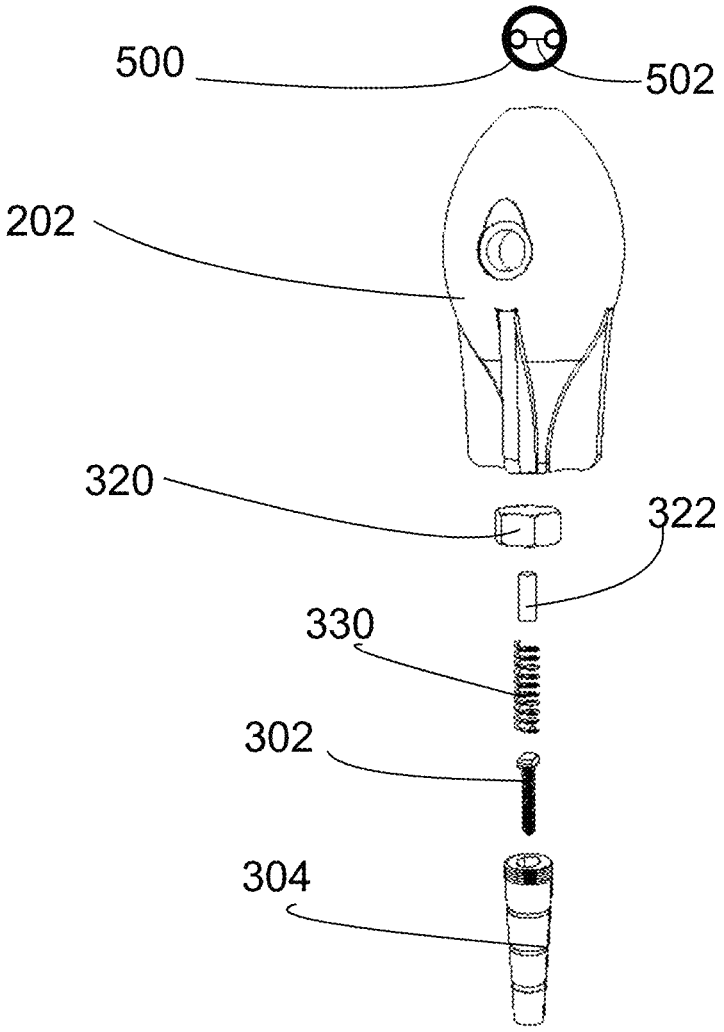
FIG. 22 is a side exploded view of an eighth embodiment of the invention showing one possible assembly of the component parts of the eighth embodiment, with the spring shown in a different axis than the remainder of the components.

FIG. 22 is a side exploded view of an eighth embodiment of the invention showing one possible assembly of the component parts of the eighth embodiment, with the spring shown in a different axis than the remainder of the components. In this embodiment the arrowhead 202 is a single piece of foam. Paintball 500 is shown, along with its diameter 502.

The cap 320, rubber stopper 332, spring 330, connector 302 and shock absorber body 304 may all be seen as well.

FIG. 23 is a side view of an arrow with the arrowhead of the invention mounted thereto, showing the complete invention with the nock embodiment, the arrowhead embodiment (having the shock absorber embodiment unseen within), assembled and unexploded. It will be appreciated that the arrow incorporating the complete parts of the invention is balanced and aerodynamic at short range, flies without tumbling (tumbling is a very dangerous flight mode, since the target might be impacted by the safety nock instead of the foam head), and still incorporates within a low weight device multiple levels of energy absorption (air release, closed cell foam, rubber stopper, and spring).

Figure 24:
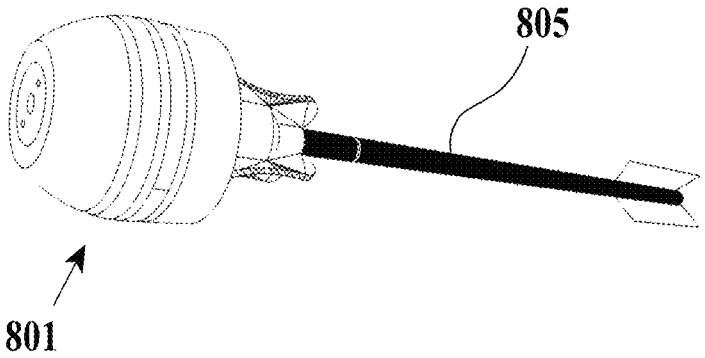
FIG. 24 is a very slightly elevated perspective side view of the presently most preferred embodiment and best mode now contemplated for carrying out the invention.
Figure 25:
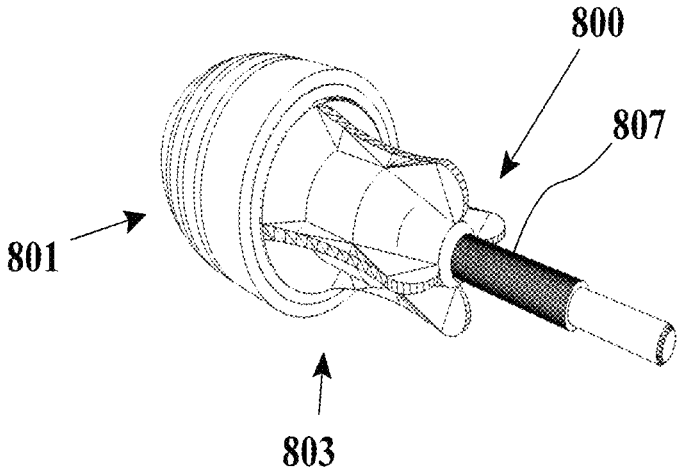
FIG. 25 is a slightly elevated side/rear view of the arrowhead of the most preferred embodiment.
Figure 26:
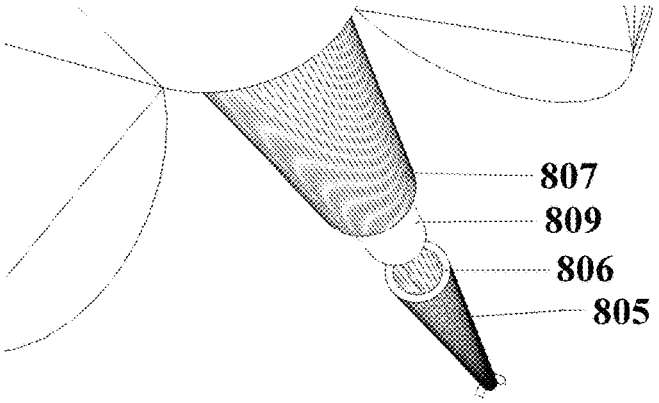
FIG. 26 is a perspective low-angle lengthwise view from the arrowhead area down-shaft (rearward) toward the flight.
Figure 27:
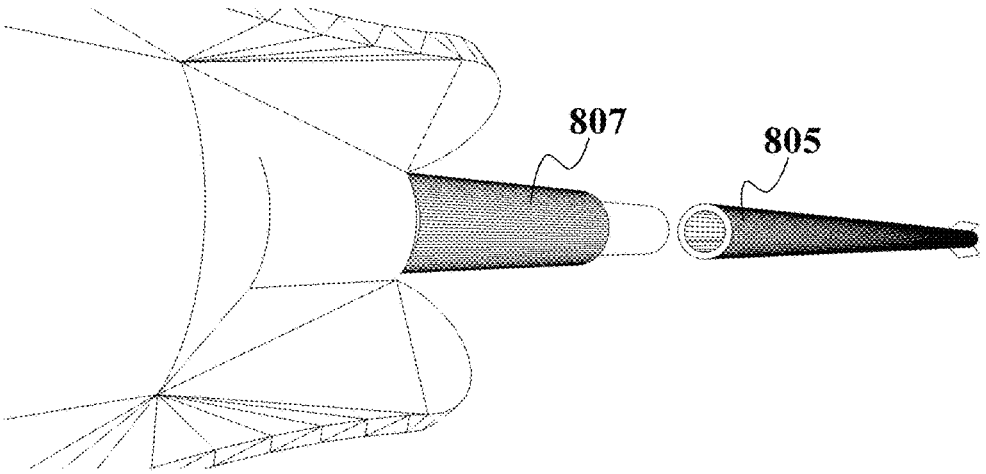
FIG. 27 is a perspective low-angle lengthwise view from the arrowhead area down-shaft (rearward) toward the flight.

FIG. 24 is a very slightly elevated perspective side view of the presently most preferred embodiment and best mode now contemplated for carrying out the invention, while FIG. 25 is a slightly elevated side/rear view of the arrowhead of the most preferred embodiment, FIG. 26 is a perspective low-angle lengthwise view from the arrowhead area down-shaft (rearward) toward the flight and FIG. 27 is a perspective low-angle lengthwise view from the arrowhead area down-shaft (rearward) toward the flight. Shock absorber 800 can be seen behind arrowhead 801 and body 803. Shock absorber 800 once again sits between arrowhead 801 and arrow shaft 805. Note that in this embodiment, the shock absorber body 804 is actually hard polymer molded or otherwise crafted into the shape of the rear half of the arrowhead, thus saving manufacturing cost and expense and more importantly, providing a simpler device to the user.

Arrow shaft 805 may be seen to have an internal bore 806 much as previously shown, this bore 806 may accept the rearmost extension 809 of the spindle/bolt/piston shaft. As previously discussed, this may be threaded to match the arrow shaft, or the two may be bonded together, etc.

By reason of being simpler, less expensive, easier to use and more reliable this version would be the best mode presently contemplated for carrying out the invention, but of even greater importance is the fact that this version is the safest yet. Part of this stems from the greater reliability of the design, but in general this design presents the most effective absorption of shock at all derivatives of motion. The rearward extension 809 of the shock absorber is no longer given enough play to enter the shock absorber body, having a shorter throw and a longer extension. In addition the fact that even under full compression the rearmost part of the piston shaft 809 (akin to the part 326, threaded portion of the bolt in previous embodiments) cannot enter the rearmost end of the shock absorber body or arrowhead means that it cannot become stuck/jammed therein and accidentally reused while already completely compressed (and thus having no shock absorbing ability at all). This further keeps the front end of the arrowshaft from ever being able to enter the body, thus preventing the join of arrow shaft 805 and piston shaft 809 from ever rubbing against the rear or even catching. As an example of the problem which this design avoids, consider if the front end of the arrow shaft 805 could enter the rear of the arrowhead. A misalignment of arrowshaft 805 and bolt/piston shaft 809 would cause a curved lip on one side and another lip on the other side, these lips would form exactly at the join of the two shafts. (Visually, the arrow might appear to be not straight, or out of true.) On one side, the arrowshaft 805 would protrude sideways and on the other the bolt 809 would do so. When the device was used, this first lip (with the arrowshaft projecting sideways more) would automatically catch on the rear end of the shock absorber and stop all further motion of the pistonhead against the spring and thus transmit all shock, unabsorbed, to the target. On elastic rebound, the other lip (with the bolt 809 projecting sideways too far) would scrape against the sides of the shock absorber body's second bore portion, slowly deforming it until something else broke under impact, with potentially catastrophic consequences to the target. Thus, this design with the arrowshaft always kept well clear of the rearmost part of the absorber, even under total compression, is much safer.

Figure 30:
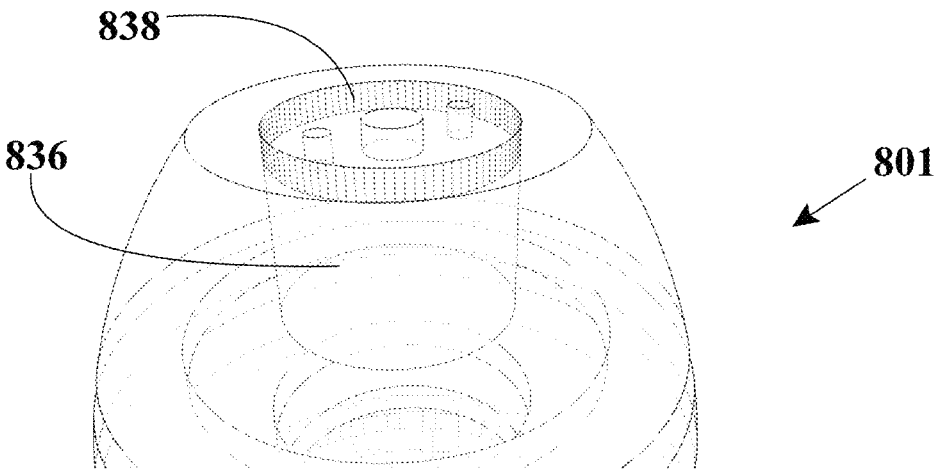
FIG. 30 is a partially transparent elevated front view of the front of the arrowhead showing the arrangement of the paint cavity, cavity top, etc.

FIG. 28 is an exploded view of the arrowhead and shock absorber of the most preferred embodiment of the invention, FIG. 29 is a partially transparent view of the shock absorber of the invention, necessary to show how the working parts fit together in this simple and safe embodiment. FIG. 30 is a partially transparent elevated front view of the front of the arrowhead showing the arrangement of the paint cavity, cavity top, etc.

Shock absorber front end 808 may have a cap-like or cup-like end item 820 with a flat head. Testing has revealed that this part alone is sufficient to provide safety, even without the foam front half of the arrowhead.

Shock absorber rear end 810 does not envelope the piston shaft rear end even under complete compression. First portion of bore 812 is a larger diameter, able to accept and give free run to the piston head 822, itself another shock absorbing element of shock absorbing material. The run is constrained at the ends, front and back. Frontward the play of the piston head 822 ends when the piston head may impact first the coil spring 830, then the rubber bumper 832, which sits against the front end cap 820. Even if the rubber bumper and spring are omitted the rearward extension cannot enter the shock absorber body even at full compression and thus the arrowshaft cannot have any portion ever enter the shock absorber body. This also prevents the problems discussed previously if the arrowhead is allowed to enter the shock absorber.

Second portion of bore 814 is smaller in diameter and thus prevents excessive rearward motion of the pistonhead 822.

Cap 820 may be threaded, bonded or otherwise secured. For example a set-screw may be used if the screw is quite small and positioned so as to not itself impact the target, and would allow the foam to be replaced if the foam has degraded during usage. Pistonhead 822 as noted earlier may itself be a shock absorbing material.

Coil spring 830 may be somewhat wider than those in previous embodiments, which may provide better response, absorption and stability.

Foam bumper 832 is as discussed previously in reference to rubber bumpers, however, for weight and balance reasons, a highly impact resistance foam is used instead in this embodiment.

Note that in the embodiment there is not a paint ball space but instead a paint cavity 836 designed for injected paint. Paint cavity cap 838 may allow paint to splash a target on impact, for example through apertures in the cap, through dislodgement, or by being a spongy material which allows transmission of paint directly through pores or interstices of the material itself. Paint may be easily injected with an injector tool or pump.

Throughout this application, various publications, patents, and/or patent applications are referenced in order to more fully describe the state of the art to which this invention pertains. The disclosures of these publications, patents, and/or patent applications are herein incorporated by reference in their entireties, and for the subject matter for which they are specifically referenced in the same or a prior sentence, to the same extent as if each independent publication, patent, and/or patent application was specifically and individually indicated to be incorporated by reference.

Methods and components are described herein. However, methods and components similar or equivalent to those described herein can be also used to obtain variations of the present invention. The materials, articles, components, methods, and examples are illustrative only and not intended to be limiting.

Although only a few embodiments have been disclosed in detail above, other embodiments are possible and the inventors intend these to be encompassed within this specification. The specification describes specific examples to accomplish a more general goal that may be accomplished in another way. This disclosure is intended to be exemplary, and the claims are intended to cover any modification or alternative which might be predictable to a person having ordinary skill in the art.

Having illustrated and described the principles of the invention in exemplary embodiments, it should be apparent to those skilled in the art that the described examples are illustrative embodiments and can be modified in arrangement and detail without departing from such principles. Techniques from any of the examples can be incorporated into one or more of any of the other examples. It is intended that the specification and examples be considered as exemplary only, with a true scope and spirit of the invention being indicated by the following claims.

We claim:

1. An arrow for use with a standard diameter paintball, the arrow comprising:

a shaft, the shaft having a threaded internal bore having an internal diameter, and front and rear ends;

fletching on the shaft at the rear end of the shaft;

a nock at the rear end of the shaft;

an arrowhead having a body having a length and front and rear ends, the arrowhead made of resilient foam, the arrowhead having on the front end a first aperture leading to a first cavity, the first cavity being partially spherical in shape, the spherical shape being bisected by the front end of the arrowhead to create the first aperture, the center of the spherical first cavity being disposed within the arrowhead, whereby the portion of the sphere made by the first cavity is more than one half of a complete sphere;

the first cavity having a diameter sufficient to secure such standard diameter paintball by means of the resilience of the foam when such standard diameter paintball is inserted therein through the first aperture;

the first aperture having a diameter smaller than the diameter of the first cavity but large enough to allow insertion of such standard diameter paintball due to the resilience of the foam;

an connecter dimensioned and configured to mechanically engage the bore of the arrow shaft;

a shock absorber, the connecter engaging the shock absorber, and the shock absorber engaging the arrowhead;

the arrowhead mounted to the arrow shaft by the connector;

on the rear end a second aperture leading to a second cavity, the rear aperture having dimensioned and configured to accept such arrow shaft;

the shock absorber disposed within the second cavity;

a shock absorber body having a generally cylindrical configuration with an internal bore running from a front end to a rear end of the shock absorber body, the internal bore having a first portion having a first bore diameter and a second portion having a second bore diameter, the first portion at the front end and the second portion at the rear end of the shock absorber body;

a cap, the cap secured to the front end of the shock absorber body, the cap covering the internal bore at the front end;

the connector having a head having a head diameter and having a connector portion having a diameter, the head diameter larger than the connector portion diameter;

the first bore diameter being larger than the head diameter, the second bore diameter being smaller than the head diameter but larger than the connector portion diameter;

the connector disposed with the connector portion in the second portion of the bore, and the head in the first portion of the bore;

whereby the connector head may be trapped within the first portion of the bore by the cap covering the internal bore at the front end and the smaller second bore diameter at the rear end of the internal bore;

a coil spring disposed within the bore between the head and the cap, the coil spring urging the connector toward the rear end of the arrowhead;

a rubber bumper disposed within the coil spring.

2. The arrow of claim 1, wherein the arrowhead further comprises:

a front section and a back section, the first cavity being in the front section and the second cavity in the back section.

3. The arrow of claim 2, further comprising:

an intermediate section of the arrowhead between the front section and the back section.

4. The arrow of claim 3, further comprising:

a third cavity, the third cavity disposed within the first section of the arrowhead, the third cavity having at least one air vent which acts to vent the third cavity slowly when the arrowhead is compressed by an impact.

5. The arrow of claim 3, wherein the resilient foam comprises: ethylene-vinyl acetate foam.

6. The arrow of claim 1, for use with a whistle, the arrow further comprising:

an opening on a side portion of the arrowhead, the opening dimensioned and configured to accept such whistle therein.

7. An arrowhead for use with paint, the arrowhead comprising:

a body having a length and front and rear ends, the arrowhead made of resilient foam, the arrowhead having on the front end a first aperture leading to a first cavity, a connecter;

a shock absorber, the connecter engaging the shock absorber, and the shock absorber engaging the arrowhead;

on the rear end a second aperture leading to a second cavity, the shock absorber disposed within the second cavity;

a shock absorber body having a generally cylindrical configuration with an internal bore running from a front end to a rear end of the shock absorber body, the internal bore having a first portion having a first bore diameter and a second portion having a second bore diameter, the first portion at the front end and the second portion at the rear end of the shock absorber body;

a cap, the cap secured to the front end of the shock absorber body, the cap covering the internal bore at the front end;

the connector disposed with the connection portion in the second portion of the bore, and the head in the first portion of the bore;

whereby the connector head may be trapped within the first portion of the bore by the cap covering the internal bore at the front end and the smaller bore diameter at the rear end of the internal bore;

a coil spring disposed within the bore between the head and the cap, the coil spring urging the connector toward the rear end of the arrowhead;

a rubber/foam bumper disposed within the coil spring.

8. The arrowhead of claim 7, further comprising:

a front section and a back section, the first cavity being in the front section and the second cavity in the back section.

9. The arrowhead of claim 8, further comprising:

an intermediate section of the arrowhead between the front section and the back section.

10. The arrowhead of claim 9, further comprising:

a third cavity, the third cavity disposed within the first section of the arrowhead, the third cavity having at least one air vent which acts to vent the third cavity slowly when the arrowhead is compressed by an impact.

11. The arrowhead of claim 7, wherein the first cavity partially spherical in shape, the spherical shape being bisected by the front end of the arrowhead to create the first aperture, the center of the spherical first cavity being disposed within the arrowhead, whereby the portion of the sphere made by the first cavity is more than one half of a complete sphere;

the first cavity having a diameter sufficient to secure such standard diameter paintball by means of the resilience of the foam when such standard diameter paintball is inserted therein through the first aperture;

the first aperture having a diameter smaller than the diameter of the first cavity but large enough to allow insertion of such standard diameter paintball due to the resilience of the foam.

* * * * *